US011305846B2

(12) United States Patent
Bowler, II

(10) Patent No.: US 11,305,846 B2
(45) Date of Patent: Apr. 19, 2022

(54) TOWABLE WATERCRAFT

(71) Applicant: Roland K. Bowler, II, Kildeer, IL (US)

(72) Inventor: Roland K. Bowler, II, Kildeer, IL (US)

( * ) Notice: Subject to any disclaimer, the term of this patent is extended or adjusted under 35 U.S.C. 154(b) by 145 days.

(21) Appl. No.: 16/886,717

(22) Filed: May 28, 2020

(65) Prior Publication Data

US 2020/0290709 A1 Sep. 17, 2020

Related U.S. Application Data

(63) Continuation-in-part of application No. 15/870,969, filed on Jan. 14, 2018, now abandoned, which is a continuation-in-part of application No. 14/698,783, filed on Apr. 28, 2015, now Pat. No. 9,919,777.

(51) Int. Cl.

| | |
|---|---|
| ***B63B 34/54*** | (2020.01) |
| ***B63B 32/60*** | (2020.01) |
| ***B63B 32/20*** | (2020.01) |
| ***B63B 34/52*** | (2020.01) |

(52) U.S. Cl.

CPC ..... *B63B 34/54* (2020.02); *B63B 32/20* (2020.02); *B63B 32/60* (2020.02); *B63B 34/52* (2020.02)

(58) Field of Classification Search

CPC ..... B63B 32/20; B63B 32/51; B63B 32/60; B63B 34/52; B63B 34/54; B63B 34/60; B63B 34/63; B63B 34/67

See application file for complete search history.

(56) References Cited

U.S. PATENT DOCUMENTS

| | | | | |
|---|---|---|---|---|
| 1,587,605 A * | 6/1926 | Scroggins | A63B 35/00 441/59 |
| 5,149,314 A * | 9/1992 | Ciolino | A61H 37/005 441/129 |
| 5,514,057 A * | 5/1996 | Ciolino | A63B 21/4037 482/111 |
| D662,564 S * | 6/2012 | Peterson | A63B 21/4037 D21/809 |
| 9,751,599 B1 * | 9/2017 | Ebrahimi | B63B 32/53 |
| 9,919,777 B2 * | 3/2018 | Bowler, II | B63B 34/52 |
| 2018/0134349 A1 * | 5/2018 | Bowler, II | B63B 34/67 |

* cited by examiner

*Primary Examiner* — Ajay Vasudeva

(57) ABSTRACT

A towable watercraft including a body member having a tow-rope hitch coupled to a front portion thereof and first and second elongated stabilizing members extending beyond an aft portion of the body member is disclosed. The stabilizing members may be coupled to the hitch or an intermediate portion between the stabilizing member may be retained about a circumferential portion of the body member, wherein first and second end portions of the first and second elongated stabilizing members having corresponding stirrups are laterally movable away from, and back toward, each other.

17 Claims, 7 Drawing Sheets

TOWABLE WATERCRAFT

REFERENCE TO RELATED APPLICATIONS

The present application is a continuation-in-part of U.S. application Ser. No. 15/870,969 filed on 14 Jan. 2018 entitled "Towable Recreational Craft With Flight Control", which is a continuation-in-part of U.S. application Ser. No. 14/698,783 filed on 28 Apr. 2015 entitled "Towable Recreational Craft", now U.S. Pat. No. 9,919,777, the contents of which are incorporated herein by reference and from which priority is claimed under 35 U.S.C. 120.

FIELD OF THE DISCLOSURE

The present disclosure relates generally to towable recreational watercraft accommodating one or more riders and more particularly to towable recreational watercraft having improved stability.

BACKGROUND

Towable recreational watercraft are known generally and are typically towed across the water by a towline fastened to a moving object like a power boat. Such watercraft have been embodied as an inner tube or inflatable body member having a towline fastened to a front portion thereof. It's also known to cover the body member with a durable material, to which a towline hitch and handles are fastened. It is also known to tow such watercraft and other devices over snow with a snow machine.

In use, recreational watercraft accommodate one or more human riders in a seated or prone position. When known watercraft are towed behind a power boat the watercraft may become unstable and tip from one side or the other when crossing a wake drawn behind the boat. Windswept waves or waves caused by other boats may also cause the watercraft to tip. There is also a tendency for such watercraft to tip or overturn when towed along a curved path, for example when towed by a power boat negotiating a tight turn. The tendency to tip while negotiating a turn exists irrespective of the calmness of the water and is aggravated when turning in the presence of waves.

The objects, features, and advantages of the disclosure will be evident from the following description of one or more embodiments herein, with reference to the accompanying drawings.

DETAILED DESCRIPTION

While the drawings illustrate various aspects of the disclosure, the elements of the various figures are not necessarily drawn to scale. The size, shape and dimensions of some portions, features, components and/or regions of the drawings may be disproportionate to provide clarity or to better convey or illustrate what is described herein.

Figure 1:
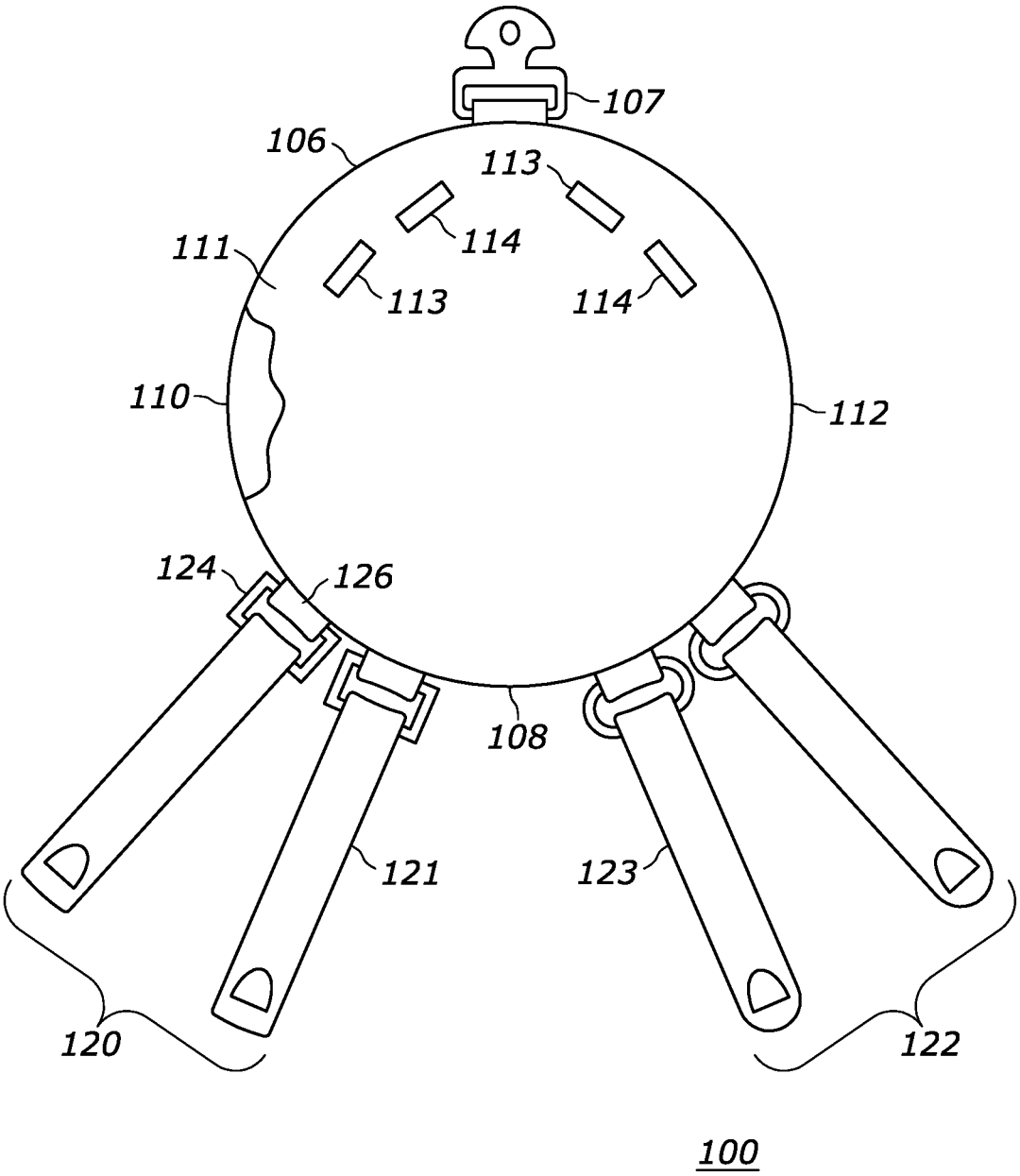
FIG. 1 is a plan view of a towable recreational craft.
Figure 2:
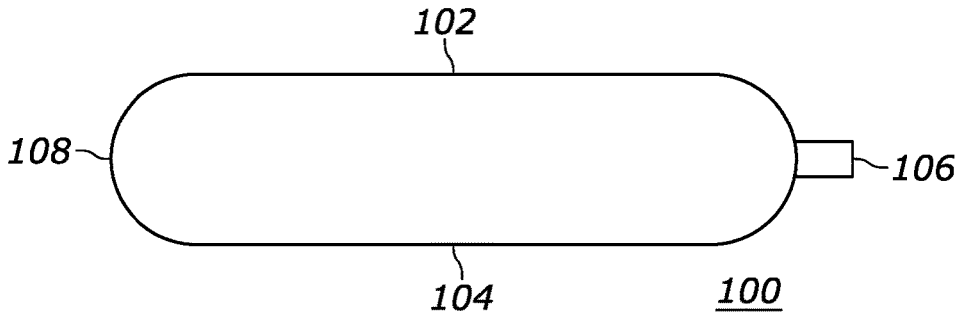
FIG. 2 is a side view of a towable recreational craft.

FIG. 1 illustrates a towable recreational craft 100 comprising a body member 110 having a top side 102, an opposite bottom side 104, a front portion 106, and a rearward portion 108. The recreational craft could be towed across water or snow. As shown, the body member has opposite lateral portions 110, 112 disposed between the front portion 106 and the aft or rearward portion 108. The body member may comprise a buoyant or semi-buoyant material. The body member may be embodied as an inflatable device like a tyre inner tube or inflatable device, which may have a variety of different shapes. An inflatable body member may be embodied as an inflatable rubber, polyvinyl chloride (PVC) or other suitable natural or synthetic material. Alternatively, the body member may be embodied as a non-inflatable device like a closed-cell extruded polystyrene material (e.g., Styrofoam) or some other non-inflatable buoyant or semi-buoyant material. Various other natural or synthetic materials may also be used for the body member. The craft may include a hitch also referred to herein as a tow-rope hitch to which a towline is fastened. In FIG. 1, a hitch 107 is fastened to the front portion of the body member. In other embodiments, the towline is tied directly to the body member or fastened to a net disposed about the body member to distribute pulling forces applied thereto.

The illustrated body member has a generally circular shape when viewed from the top or bottom. In other embodiments, the body member could have most any other shape. Such other shapes include but are not limited to an oblong or oval, rectangular, triangular, square or some other polygon or quasi-polygonal shape. Generally, the surfaces of the top and bottom sides of the body member may be flat or non-flat. For example, the bottom side surface could be convex or concave. The body member may also have a central keel or one or more fins or skegs extending from the bottom side thereof for directional stability. The fins or skegs may be disposed laterally or along the centerline. In some embodiments, the fins or skegs are adjustably retractable. Whether the bottom side surface is concave or convex may have some bearing on the placement of any fins or skegs. The top side surface of the body member is generally configured to accommodate one or more riders in the prone position with legs and feet extending from the aft and lateral portions of the body member. Thus the top surface may have a flat, convex, or concave configuration. In one particular embodiment, the top surface has a somewhat concave recess extending between the front and rearward portions of the body member. In another embodiment, the top surface has two or more generally side-by-side concave recessed portions for accommodating two side-by-side riders. A centerline of the concave recesses may be parallel or divergent toward the rearward portion of the body member.

In one embodiment the inflatable or non-inflatable body member is covered with another material like nylon or PVC or some other material. For example, the body member may be encapsulated by a nylon or neoprene sheath, or a plastic shell or some other material. FIG. 1 shows a portion of the sheath or shell in removed from the body member. The body member may also be covered by a combination of these and other materials. A sheath-type covering may include an opening through which to accommodate the body member. Such an opening may be securely closeable with a zipper, or buttons, or by mating hook and loop straps like Velcro, or by some other secure fastening mechanism. The opening in the sheath may be relatively small to accommodate an inflatable body member also referred to herein as a bladder, but the opening could be relatively large to accommodate a non-inflatable body member. Alternatively, a shell-type covering may be fastened to, or integrally formed about, the body member. For example, a non-inflatable body member may include a shell made of plastic or some other durable material fastened thereto by an adhesive or by separate molding operations or by other means. Alternatively, the body member has no such covering. The materials selected will depend on consideration of the intended use or application of the craft. For applications where the craft is towed over snow, for example, materials having less frictional drag may be advantageous. In some applications however some drag may be desirable for directional stability.

In some embodiments, the body member includes a handle disposed at or near the front portion thereof for grasping by a rider. The handle could take many forms. For example, there could be a single elongated handle for grasping by one or more riders. Alternatively, the handle could be embodied as a pair of handles, one for grasping by each hand of the rider. FIG. 1 illustrates the body member having two sets of handles 113, 114 on the top side near the front portion. In this embodiment, each pair of handles accommodates a corresponding one of two riders in a prone position. In embodiments where the body member includes a sheath, the handles may be embodied as straps sewn, riveted or otherwise fastened to the sheath. The tow-rope hitch may also be coupled or fastened to the sheath as shown in FIG. 1. Alternatively, the one or more handles may be embodied as an integral part of the body member or a plastic shell thereof. For example, such handles could be formed as a unitary part of the body member by a molding process or by some other process. In embodiments devoid of a sheath or shell covering the buoyant body member, the one or more handles may be fastened directly to the body member. In other embodiments, the watercraft is devoid of handles, wherein the rider merely grasps a front portion of the body member with his or her arms.

In one embodiment, the body member includes one or more stabilizing members movably coupled thereto. The stabilizing member extends generally away from the body member and is movable between a position extending away from the rearward portion of the body member and a position extending away from one or both the lateral portions of the body member. Each stabilizing member includes a foot-accommodating portion spaced apart from the body member.

Figure 11:
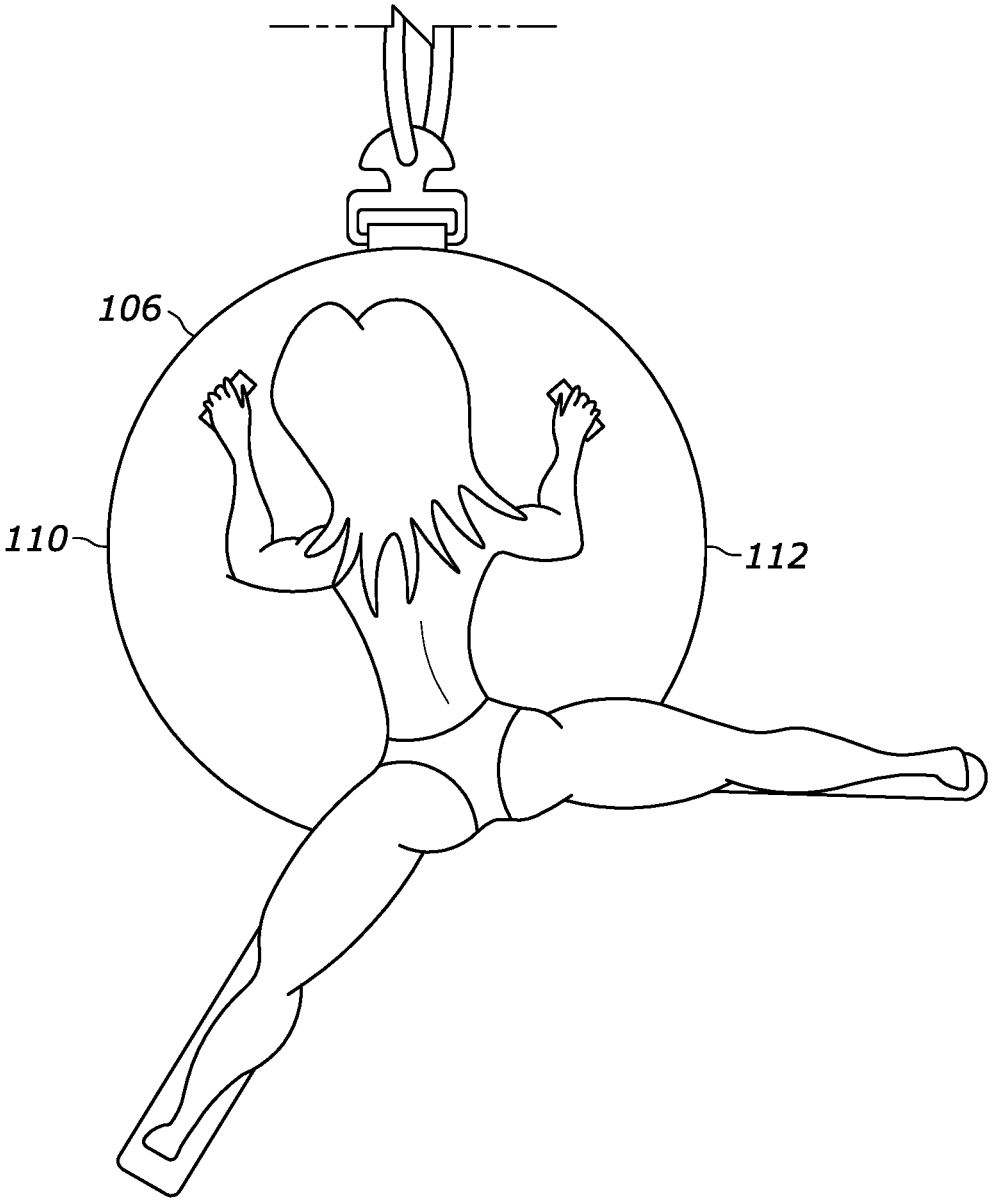
FIG. 11 is a plan view of a towable recreational craft with a rider.

In operation, a rider assumes a prone position on the top side of the body member with the rider's legs extending from the rearward portion thereof. The rider is positioned to grasp the recreational craft with his or her hands or arms as discussed above. One or both of the rider's feet are disposed in a foot-accommodating portion of the one or more stabilizing members. For the case where there are two stabilizing members, each foot is disposed in a foot-accommodating member of a corresponding stabilizing member. The articulating nature of the stabilizing members allows the user's legs to move independently between the aft position and the lateral sides 110, 112 of the body member thereby providing improved stability as the recreational craft is towed across the water or snow as shown in FIG. 11. The positioning of the rider's leg or legs toward the lateral portion of the body member will reduce the likelihood that the body member will tip, for example while negotiating a turn or rough water. For the case where there is a single stabilizing member, the foot accommodating member may be sized to accommodate both feet of the rider. The articulating nature of the single stabilizing member allows the rider's legs to move in unison from side to side, thereby providing stability as the craft is towed across the water or snow. Alternatively, the the rider could alternate which foot is disposed in the foot-accommodating portion of the single stabilizing member depending on which side of the body member the rider wants to position the stabilizing member for stability, while allowing the other leg to extend from the aft portion of the body member.

In one embodiment, the one or more stabilizing members include a directional guiding member extending from a bottom side thereof. The stabilizing member is disposed a sufficient distance from the body member to allow the directional guiding member to extend into the water or snow and to provide rudder-like functionality as the craft is towed. The directional guiding member could be part of the foot-accommodating member or a discrete member separate therefrom. In either case, the directional guiding member is maintained in the water or snow by downward pressure from the rider's foot disposed in the foot-accommodating portion of the stabilizing member. Thus the directional guiding member provides the rider a measure of control over the direction of the craft.

In FIG. 1, the body member includes two pair of stabilizing members extending from the aft portion of the body member. In this embodiment, the first pair of stabilizing members 120 accommodates one rider and the second pair of stabilizing members 122 accommodates an adjacent rider. The pairs of stabilizing member 120, 122 are shown disposed symmetrically about a centerline of the body member. In another embodiment, only a single pair of stabilizing members, for example, members 121, 123 in FIG. 1, are disposed symmetrically about the centerline to accommodate a single rider. In another embodiment, a single stabilizing member, not shown, extends from the aft portion of the body member to accommodate a single rider as discussed above.

The one or more stabilizing members are movably fastened to corresponding retaining members formed in or fastened to the body member. In FIG. 1, the stabilizing member is embodied as a strap fastened to a retaining member 124 embodied as a ring or rectangular or D-shaped member fastened to the body member by an anchor 126. In this embodiment, the one side of the retaining member is captured by the anchor 126 and the other side of the retaining member retains the stabilizing member. A curved shape retaining member may better accommodate articulation of the stabilizing member.

In one embodiment, the one or more stabilizing member are embodied as straps formed of a nylon material. In some applications the stabilizing strap is strengthened with a carbon fiber cloth or other reinforcing material captured between layers of the strap. The stabilizing strap may be fastened to the retaining member (e.g., the D-shaped member) by forming a loop that captures the retaining member upon sewing or riveting or otherwise fastening together mating portions of the strap. In FIG. 1, the one or more anchors 126 are fastened directly to, or formed integrally with, the body member. In embodiments where the body member includes an outer sheath, the anchors and sheath may constitute a unitary member. Alternatively, the anchors may be discrete parts that are sewn, riveted or otherwise fastened to the sheath. In some applications the anchor is strengthened with a carbon fiber cloth or other reinforcing material captured between layers of the anchor and between layers of the sheath at least in the region where the anchor is fastened thereto. Alternatively, the stabilizing strap may be attached directly to the sheath without the intermediate retaining member. In other embodiments, the retaining members are integrally formed with the body member. For example, the retaining members may be formed as part of the body member, or as part of a body member shell, in a molding or other forming operation.

In other embodiments, the stabilizing member may have other forms. For example, the stabilizing member could be embodied as a cord with one end fastened to the body member wherein the other end fastened is fastened to, or is integrally formed with, a foot accommodating portion. The cord could be made of nylon or some other material with suitable tensile strength. The cord could be rigid or flexible. A rigid cord would require a movable coupling to the body member, for example with a retaining ring. A flexible cord could be anchored directly to the body member without the need for an intermediate retaining member. Various other mechanisms and materials may be employed to form the one or more stabilizing members and to fasten them to the body member or to a sheath or covering disposed about the body member.

Figure 3:
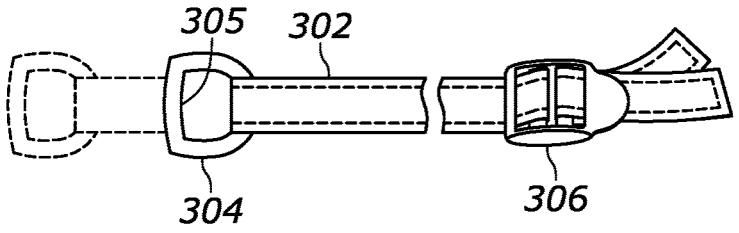
FIG. 3 is a plan view of a stabilizing member.
Figure 4:
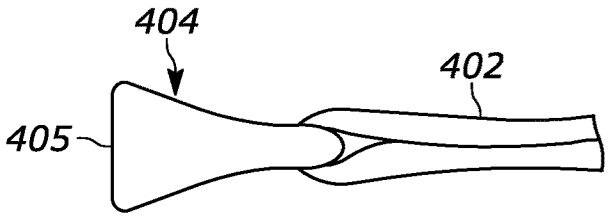
FIG. 4 is a side view of a stabilizing member.
Figure 5:
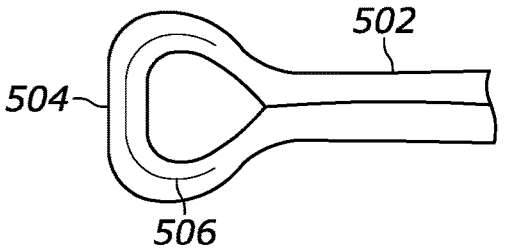
FIG. 5 is a plan view of another stabilizing member.
Figure 6:
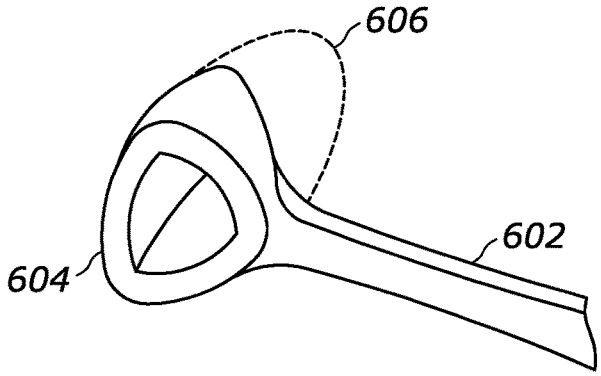
FIG. 6 is a perspective view of another stabilizing member.

In one embodiment, the foot-accommodating member comprises a stirrup into which the user's foot is disposed. FIG. 3 is plan view of a stabilizing member portion 302 embodied as a strap having a stirrup 304 fastened to an end thereof. The stirrup has a relatively flat portion 305 that supports the user's foot. FIG. 4 is side view of a stabilizing member portion 402 embodied as a strap looped through a stirrup 404. The strap has mating portions stitched, riveted or otherwise fastened together to capture the stirrup. FIG. 4 shows the foot support 405 having increased surface area to more comfortably accommodate the user's foot. In one embodiment, the stabilizing member is made of nylon, or a carbon fiber reinforced material or other suitably strong material. FIG. 5 illustrates a stabilizing member embodied as a strap 502 including an open loop 504 formed at the distal end thereof into which the user's foot may be disposed. In embodiments where the strap comprises a flexible material like nylon, a rigid member 506 may be embedded between layers of material to provide greater rigidity to the stirrup and to reduce a tendency of the non-rigid stirrup to clamp the user's foot when under load. The stirrup of FIGS. 3 and 4 may be made of plastic, carbon fiber or some other material having suitable strength, durability and water resistance. In FIG. 6, the stabilizing member is embodied as a cord 602 with a stirrup 604 disposed at the distal end thereof. The stabilizing member and stirrup may constitute a unitary member or the stirrup may be a discrete part fastened to the stabilizing member.

Figure 7:
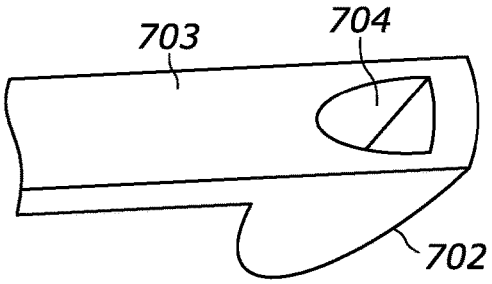
FIG. 7 is a perspective view of another stabilizing member.

In FIG. 7, the stirrup is part of a foot-accommodating pocket 702 protruding from a bottom side of the stabilizing member 703. The pocket is accessible via an opening 704 on a top side of the stabilizing member. In FIG. 7, the pocket is a open-ended boot-like member formed integrally with, or fastened to, the stabilizing member. A toe portion of the pocket may be fully or partially closed to fully or partially protect the user's feet. For aquatic applications, a closed-ended boot may have one or more holes to permit fluid drainage while still providing substantial foot protection. In one embodiment, the pocket is a non-rigid material, like nylon, that is integrally formed with a stabilizing member comprising the same or similar material. For example, the pocket could be formed integrally with a strap portion of the stabilizing member. Alternatively, the boot could be formed of a rigid or semi-rigid material like plastic, or rubber, or some other suitable material that is fastened to the stabilizing member. In one embodiment, the boot has a relatively rigid outer shell with a softer inner lining for greater comfort. The inner lining could be formed of foam rubber or some other suitable material. In one embodiment, a plastic boot is sewn, riveted or otherwise fastened to a strap-shaped stabilizing member. FIG. 6 illustrates the stirrup fastened to a cord wherein the stirrup has a fully or partially closed end portion 606. The cord could be flexible or rigid. If the stabilizing member is inflexible, then it could be movably coupled to the body member by a retaining member to permit articulation as discussed herein.

Figure 8:
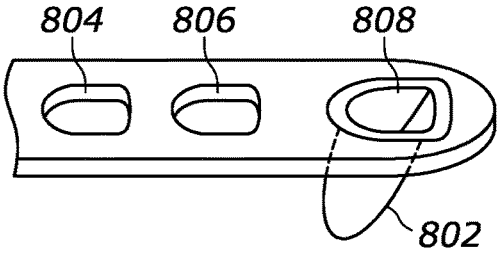
FIG. 8 is a perspective view of another stabilizing member.

In one embodiment, the foot-accommodating portion is adjustably spaced apart from the body member. An adjustable foot-accommodating portion accommodates different sized riders and it accommodates different positioning of the rider on the body member. In one embodiment, shown in FIG. 3, adjustment is provided for a strap-like stabilizing member using an adjustable tension buckle 306 disposed between the foot-accommodating portion and the body member. In this embodiment, the strap is looped through a retaining member and threaded through the adjustable tension buckle, wherein the strap length is adjustable by feeding more or less strap through the buckle. Such a buckle could be implemented in the embodiments of FIG. 3 and FIG. 7. In another embodiment, adjustment is provided by a plurality of foot-accommodating portions spaced apart along the stabilizing member at different locations from the body member wherein the rider could utilize the foot-accommodating member at the most appropriate distance from the body member. For example, multiple stirrups could be linked together with intervening strap portions as shown in broken lines in FIG. 3. Similarly adjustment could be provided with multiple pockets arranged in series along the stabilizing member of FIG. 7. In the alternative embodiment of FIG. 8, adjustability is provided by an open-ended rigid or semi-rigid boot 802 removably disposed in any one of several openings 804, 806 or 808 formed along the stabilizing member. The boot could be retained in the opening by friction fit or by Velcro or by clamping a portion of the stabilizing member between a flange of the boot and a mating ring or strip or material. The ring or material strip could be fastened to the flange using removable bolts or other fasteners.

Figure 9:
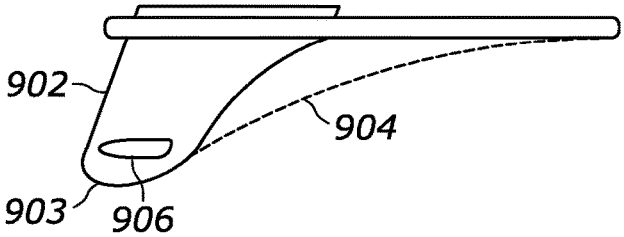
FIG. 9 is a side view of another stabilizing member.

In one embodiment, an outer portion of the boot constitutes the directional guiding member extending from the stabilizing member. FIG. 9 illustrates the boot 902 having a fin shaped portion 903. The fin provides the rider with a measure of control over how the stabilizing member and to some extent the body member track over the snow or water. Alternatively, the directional guiding member may be a discrete member spaced separate and apart from the boot, for example toward a distal end of the stabilizing member away from the body member. In some embodiments, drag produced by the boot is reduced by providing an elongated tapered portion 904 (shown in broken lines) extending from the boot toward the body member. The tapered portion may be an integral part of the boot or the tapered portion may be a separate part that is fastened to the boot and or the stabilizing member. The tapered portion could also be an integral part of the stabilizing member or the tapered portions could be formed unitarily with the stabilizing member.

Figure 10:
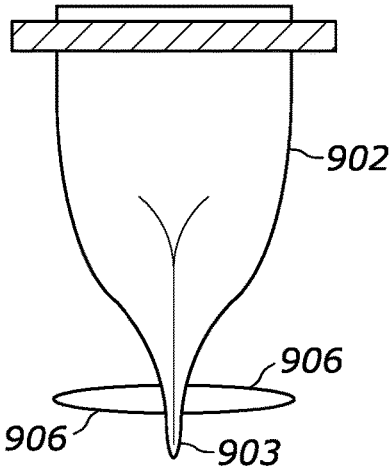
FIG. 10 is an end view of FIG. 9.

In some embodiments, one or more winglets extend laterally from a lower portion of a boot. The one or more winglets are used mostly for aquatic applications and are optional. The winglets are positioned to remain under water, enabling the rider to better maintain the boot or stabilizing member in the water. In one embodiment, a single winglet extends from an aft portion of a lower part of the boot. The winglet may also extend from lateral sides or an aft portion of the fin or directional guiding member. FIG. 9 also illustrates the directional guiding member including laterally extending winglets 906. FIG. 10 is a front view of the boot 902 having a fin-shaped portion 903 as shown in FIG. 9. The fin and winglets can be embodied as separate accessories fastened to the boot or directional guiding member or the one or more winglets can be an integral part of the fin or the boot or both.

In another embodiment, a towable watercraft comprises an elongated stabilizing member coupled to the front portion of the body member wherein an end portion having a stirrup extending beyond the aft portion of the body member is movable between a position extending away from the aft portion of the body member and a position adjacent one of two lateral portions of the body member. The stirrup may be part of a pocket embodied as an open-ended boot or other structure and may, optionally, include a directional guiding member, as described herein. An adjustable tension buckle may also be disposed along the stabilizing member between the hitch and the stirrup as described herein. In one embodiment, the elongated stabilizing member includes first and second elongated stabilizing members, each having a corresponding end portion with a stirrup extending beyond the aft portion of the body member, wherein the end portions are movable laterally away from, and back toward, each other when a rider's feet are disposed in the stirrups. The stabilizing member may comprise a strap or cord or other ligament as described herein.

In one implementation, the elongated stabilizing member is coupled directly to the tow-rope hitch or by an intermediate member coupled to the hitch. Alternatively, the elongated stabilizing member is coupled to a tow-rope coupled to the hitch, rather than to the hitch, wherein the stabilizing member is coupled to the rope forward of the hitch. Thus configured, a load on the elongated stabilizing member is transferred to the hitch and ultimately to the tow-rope to which the hitch is coupled. In either case, the one or more elongated stabilizing members are movable between a position extending away from the aft portion of the body member and a position adjacent one of two lateral portions located on opposite sides of the body member. In implementations including two stabilizing members, the end portions of the two stabilizing members are movable laterally away from, and back toward, each other.

Figure 12:
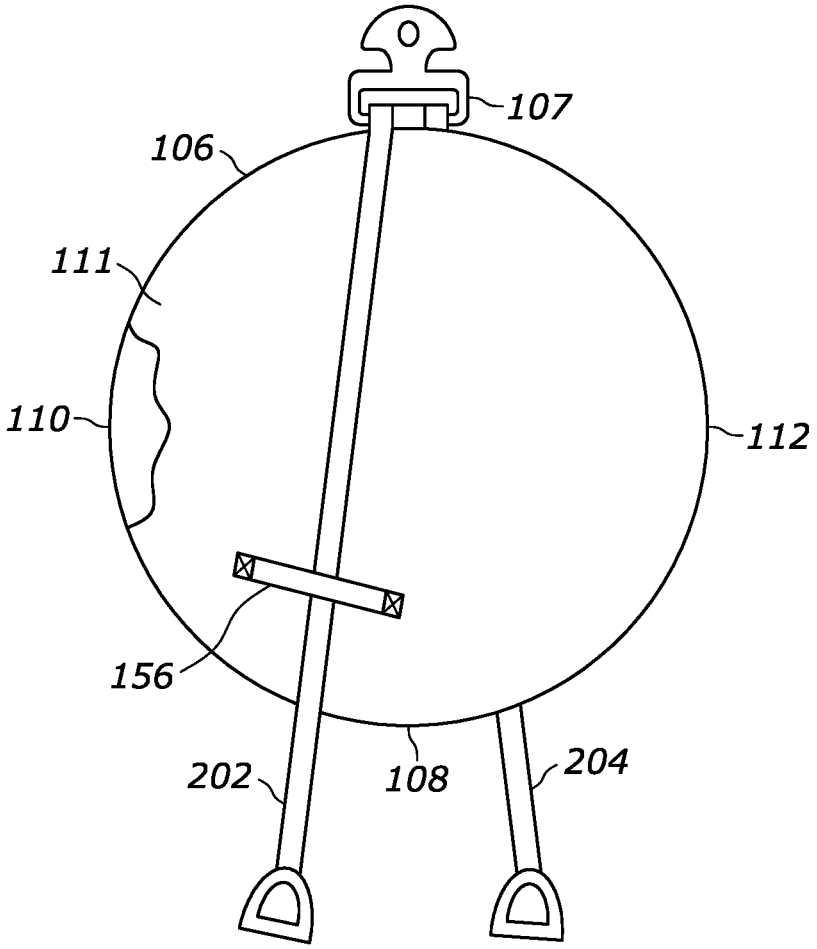
FIG. 12 is a bottom plan view of a towable watercraft.

In FIG. 12, the elongated stabilizing member coupled to the tow-rope hitch 107 comprises first and second stabilizing members 202 and 204 each having end portions with a stirrup extending beyond the aft portion of the body member as described herein. FIG. 12 shows the two stabilizing members embodied as discrete members each having a corresponding end portion coupled directly to the hitch. Alternatively, the two stabilizing members may be coupled to, or be an integral part of, a Y-shaped member having its single branch coupled directly to the hitch. In another implementation, the two stabilizing members are part of a single unitary member having an intermediate portion coupled to the hitch. The coupling of the intermediate portion to the hitch may be formed by fastening the intermediate portion of the unitary stabilizing member directly or indirectly to, or looping it about an opening in, the hitch, or by some other coupling mechanism.

The elongated stabilizing members may extend along the top or bottom portion of the body member. FIG. 12 shows stabilizing member 202 disposed along the bottom side of the body member and stabilizing member 204 disposed along the top side thereof. In most implementations both stabilizing members are disposed along either the top or bottom side of the body member. In implementations where the body member includes an inflatable bladder and an outer sheath, the elongated stabilizing members may extend between the bladder and the sheath along the same or opposite sides of the bladder. In implementations that include a sheath and bladder between which the stabilizing members extend, the sheath may include one or more openings at the front portion of the body member through which the stabilizing member or members enter from the hitch or tow-rope, and one or more exit openings through the sheath at the aft portion of the body member through which the stabilizing member or members extend.

In implementations where the stabilizing members are disposed on the outer top or bottom outer sides of the body member, the stabilizing members may be retained adjacent thereto by one or more retaining members while permitting lateral movement of the stabilizing members as described herein. FIG. 12 shows the stabilizing member 202 retained by a retaining member 156 without limiting lateral movement of the stabilizing member. Such retaining members may be implemented as nylon strap having end portions fastened to the sheath or other portion of the body member. In some implementations, each stabilizing member is retained by a separate retaining member. In other implementations, a single retaining member retains both stabilizing members.

Figure 13:
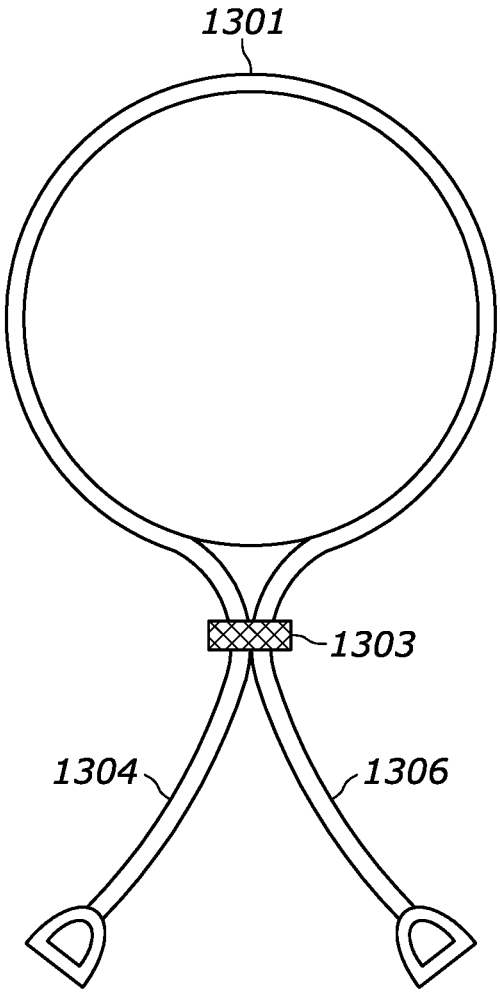
FIG. 13 is a plan view of a towable recreational craft with first and second stabilizing members interconnected by an intermediate portion.

In another embodiment, shown in FIG. 13, an intermediate portion 1301 interconnects a first stabilizing member 1304 and a second elongated stabilizing member 1306, wherein the intermediate portion is disposed at least partially about the front portion 1302 of the body member. The intermediate portion 1301 may be a strap or band, a portion of which is retained or otherwise located about at least a portion of the body member. In some implementations, the stabilizing members are drawn further about the aft portion of the body member by a retention or drawing member 1303 that draws together the stabilizing members at an aft portion of the body member. The retention member 1303 may be a strap, band, stitching or other member tending to draw the stabilizing members together and about the body member. In other implementations, the stabilizing members are not drawn fully about the aft portion of the body member as shown in FIG. 13.

Figure 14:
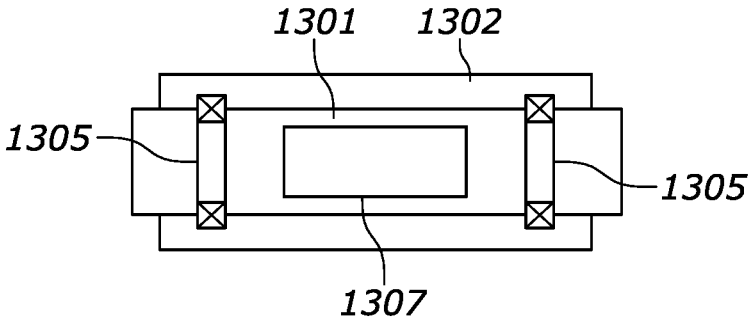
FIG. 14 shows the intermediate portion coupled to the front portion of the body member.

In implementations where the body member includes an inflatable bladder at least partially covered by a sheath, the intermediate portion of the stabilizing member is adjacent the sheath. FIG. 14 shows the intermediate portion 1301 disposed about the front portion 1302 of the body member and located thereabout by straps 1305 fastened to the body member, to ensure that the load on the stabilizing members is transferred to a circumferential part of the body member.

Additional straps, not shown, can retain the intermediate portion to lateral portions and optionally the aft portion of the body member depending on the extent to which the intermediate portion or member extends thereabout. The intermediate portion may also include an opening 1307 to accommodate the hitch in implementations where the intermediate portion would otherwise interfere with the hitch.

Figure 15:
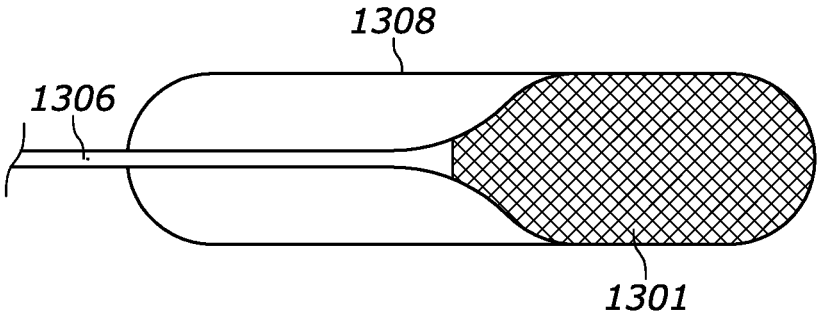
FIG. 15 is sectional view of a front portion of the body member.
Figure 16:
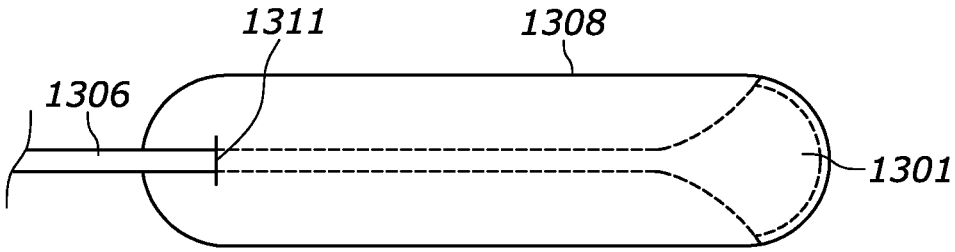
FIG. 16 is a partial side view.

The intermediate portion disposed about the front portion of the body member can be sized to better distribute the load to the circumferential part of the body member. In some implementations a front portion of the intermediate portion can have a contoured or cup-shaped section that wraps partially about the front, top and bottom portions of the body member to help locate the intermediate portion thereabout. FIG. 15 shows the such intermediate portion 1301 disposed about an outer portion of the body member and sized and shaped to wrap partially about the front portion thereof. The stabilizing members comprises strap portions only one of which, 1306, is shown in FIG. 15 can be fastened to or be an integral part of the intermediate portion. The integrally formed stabilizing members and intermediate portion 1301 can be formed as a bra-like member that slips over the front portion of the body member. An opening on the front of the intermediate portion, like opening 1307 in FIG. 14, can accommodate the hitch or tow rope. A draw strap, like strap 1303 in FIG. 13, can optionally be used to retain the integral member about the body member. Thus configured the bra-like member can be retrofit onto existing towable watercraft as discussed further herein. In other embodiments, retention straps, like straps 1305 in FIG. 14, fastened to an outer surface of the sheath can retain the intermediate portion to the body member. In FIG. 16, the intermediate portion 1301 is disposed between the inflatable bladder and the sheath. In this embodiment, retention straps may be fastened to an inner surface of the sheath between the sheath and the bladder. FIG. 16 also shows the intermediate portion having a contoured or cup-shaped section that wraps partially about the bladder to locate the intermediate portion about the front portion of the body member. The first and second stabilizing members may extend through a common opening at an after portion of the body member or through corresponding openings, depending on the desired separation between the stabilizing members. FIG. 16 shows the stabilizing member 1306 extending through an opening 1311 in the sheath.

In another implementation, the intermediate portion and the first and second stabilizing members are an integral part of the sheath. For example, the intermediate portion may be stitched to the sheath, and the stabilizing members may be straps formed of the same material as the sheath. In one implementation, the sheath is disposed at least partially over the top and bottom sides of the inflatable bladder, and the first and second elongated stabilizing members extend from the top or bottom side of the inflatable bladder.

In another implementation, the first and second elongated stabilizing members are part of a retro-fit stabilizing system for existing towable watercraft. The system comprises the bra-like configuration described herein removably disposable at least partially over an outer portion of the front, and at least portions of the top and bottom sides of the body member. The bra-like member can be retained by friction fit or by adjustable retention members like hook and loop fasteners (e.g., Velcro) that securely retain the bra to different sized body members. Alternatively, the intermediate member may be a net material disposed about the body member and from which the stabilizing members extend as shown in FIG. 15. In one implementation, the net member is elastic and is retained about the body member by elastic forces. The first and second elongated stabilizing members can have corresponding end portions extending beyond an aft portion of the body member and stirrups can be coupled to the end portion of the stabilizing members as described herein. In one implementation, the bra and the first and second elongated stabilizing members form a unitary member. The stabilizing members may comprise strap, cord or other ligaments. The stirrups can be part of open-ended boot and may also include winglets as described herein.

While the disclosure and what are presently considered to be the best modes have been described in a manner that establishes possession thereof by the inventor and that enables those of ordinary skill in the art to make and use the same, it will be understood and appreciated that there are many equivalents to the embodiments disclosed herein and that myriad modifications and variations may be made thereto without departing from the scope and spirit of the disclosure, which is to be limited not by the exemplary embodiments but by the appended claims.

The invention claimed is:

1. A towable watercraft comprising:

a body member;

a tow-rope hitch coupled to a front portion of the body member;

two non-inflatable elongated stabilizing members coupled to the body member, each non-inflatable elongated stabilizing member having an end portion extending beyond an aft portion of the body member;

a stirrup coupled to the end portion of each non-inflatable elongated stabilizing member, the end portions of the two non-inflatable elongated stabilizing members movable laterally away from, and back toward, each other; and the non-inflatable elongated stabilizing members are coupled to the tow-rope hitch, wherein a load on the elongated stabilizing members is transferred to the tow-rope-hitch.

2. The watercraft of claim 1, wherein the non-inflatable elongated stabilizing member comprises a strap or cord.

3. The watercraft of claim 2, wherein the body member includes an inflatable bladder covered by a sheath and the tow-rope hitch is coupled to the sheath.

4. The watercraft of claim 3, wherein each stirrup is part of a pocket coupled to the end portion of the corresponding non-inflatable elongated stabilizing member, each pocket having an open-end portion, a substantially closed-end portion, and an inner portion accessible from the open-end portion.

5. A towable watercraft comprising:

a body member;

a tow-rope hitch coupled to a front portion of the body member;

a first elongated stabilizing member having a first end portion extending beyond an aft portion of the body member;

a second elongated stabilizing member having a second end portion extending beyond the aft portion of the body member;

an intermediate portion disposed between the first elongated stabilizing member and the second elongated stabilizing member, the intermediate portion disposed at least partially about the front portion of the body member;

a first stirrup coupled to the first end portion of the first elongated stabilizing member;

a second stirrup coupled to the second end portion of the second elongated stabilizing member, wherein the first and second end portions of the first and second elongated stabilizing members are laterally movable away from, and back toward, each other.

6. The watercraft of claim 5, wherein the body member comprises an inflatable bladder at least partially covered by a sheath, the intermediate portion disposed between the sheath and the inflatable bladder, and the first and second elongated stabilizing members extend through an opening in the sheath.

7. The watercraft of claim 5, wherein the body member comprises an inflatable bladder at least partially covered by a sheath, and wherein the intermediate portion and each of the first and second elongated stabilizing members are an integral part of the sheath.

8. The watercraft of claim 5, wherein each of the first and second elongated stabilizing members comprises a strap portion adjustably lengthened by a corresponding tension buckle, wherein a spacing between each stirrup and the aft portion of the body member is adjustable.

9. The watercraft of claim 5, wherein the first stirrup is part of a first pocket coupled to the first end portion of the first elongated stabilizing member and the second stirrup is part of a second pocket coupled to the second end portion of the second elongated stabilizing member, each of the first and second pockets having a corresponding open-end portion and a substantially closed-end portion.

10. The watercraft of claim 5, wherein the first and second elongated stabilizing members are non-inflatable.

11. The watercraft of claim 10, wherein the body member includes an inflatable bladder at least partially covered by a sheath, and wherein the intermediate portion of the non-inflatable elongated stabilizing members is adjacent the sheath.

12. The watercraft of claim 10, wherein the body member includes an inflatable bladder at least partially covered by a sheath, and wherein the intermediate portion of the non-inflatable elongated stabilizing members is disposed between the sheath and the inflatable bladder, and the first and second non-inflatable elongated stabilizing members extend through an opening in the sheath.

13. The watercraft of claim 10, wherein the body member includes an inflatable bladder at least partially covered by a sheath, and wherein the intermediate portion and the first and second non-inflatable elongated stabilizing members are an integral part of the sheath.

14. A towable watercraft comprising:

a body member including an inflatable bladder and a sheath disposed over and at least partially about a front portion of the inflatable bladder, a tow-rope hitch coupled to the front portion body member;

a first elongated stabilizing member extending from the sheath and having a first end portion extending beyond an aft portion of the body member;

a second elongated stabilizing member extending from the sheath and having a second end portion extending beyond the aft portion of the body member;

a first stirrup coupled to the first end portion of the first elongated stabilizing member;

a second stirrup coupled to the second end portion of the second elongated stabilizing member, wherein the first and second end portions of the first and second elongated stabilizing members extending beyond an aft portion of the body member are laterally movable away from, and back toward, each other; and wherein the sheath is disposed at least partially over top and bottom sides of the inflatable bladder, and the first and second elongated stabilizing members extend from a portion of the sheath disposed over the top or bottom sides of the inflatable bladder.

15. The watercraft of claim 14, wherein the first and second elongated stabilizing members are non-inflatable members.

16. The watercraft of claim 14, wherein the first and second elongated stabilizing members are an integral part of the sheath.

17. The watercraft of claim 14, wherein the first stirrup is part of a first pocket coupled to the first end portion of the first elongated stabilizing member and the second stirrup is part of a second pocket coupled to the second end portion of the second elongated stabilizing member, each of the first and second pockets having a corresponding open-end portion and a substantially closed-end portion.

* * * * *